US009711320B2

(12) United States Patent
Zou et al.

(10) Patent No.: US 9,711,320 B2
(45) Date of Patent: Jul. 18, 2017

(54) EMITTER DEVICES FOR USE IN X-RAY TUBES

(71) Applicant: General Electric Company, Schenectady, NY (US)

(72) Inventors: Yun Zou, Clifton Park, NY (US); Carey Shawn Rogers, Brookfield, WI (US); Sergio Lemaitre, Whitefish Bay, WI (US); Mark Alan Frontera, Ballston Lake, NY (US); Xi Zhang, Ballston Lake, NY (US)

(73) Assignee: General Electric Company, Niskayuna, NY (US)

( * ) Notice: Subject to any disclaimer, the term of this patent is extended or adjusted under 35 U.S.C. 154(b) by 420 days.

(21) Appl. No.: 14/264,075

(22) Filed: Apr. 29, 2014

(65) Prior Publication Data

US 2015/0311025 A1 Oct. 29, 2015

(51) Int. Cl.
*H01J 35/06* (2006.01)

(52) U.S. Cl.
CPC ..... *H01J 35/06* (2013.01); *H01J 35/065* (2013.01)

(58) Field of Classification Search
CPC ..... H01J 35/06; H01J 35/065
USPC ..... 378/122, 136
See application file for complete search history.

(56) References Cited

U.S. PATENT DOCUMENTS 5,033,072 A 7/1991 Fournier et al.
5,044,005 A 8/1991 De Fraguier et al.
6,554,179 B2 4/2003 Horner et al.
6,713,312 B2 3/2004 Blalock et al.
6,738,453 B2 * 5/2004 Taguchi ..... H01J 1/20 378/134
7,512,215 B2 * 3/2009 Morton ..... H01J 35/04 378/10
7,539,286 B1 * 5/2009 Bandy ..... H01J 1/135 378/121
7,627,087 B2 * 12/2009 Zou ..... H01J 1/304 378/122
7,657,002 B2 * 2/2010 Burke ..... H01J 35/06 378/136

(Continued)

FOREIGN PATENT DOCUMENTS

EP 2407997 A1 1/2012

OTHER PUBLICATIONS

Sato et al.,"Fabrication and Characterization of HfC Coated Si Field Emitter Arrays", Journal of Vacuum Science & Technology B: Microelectronics and Nanometer Structures, vol. 21, Issue 4, pp. 1589-1593, Jul. 2003.

(Continued)

*Primary Examiner* — Allen C. Ho
(74) *Attorney, Agent, or Firm* — Pabitra K. Chakrabarti

(57) ABSTRACT

An emitter device having an emission surface includes a plurality of ligaments configured to emit electrons in response to an applied electric field resulting from an applied electrical voltage. Further, the emitter device includes a plurality of slots configured to provide physical separation between two or more adjacently disposed ligaments of the plurality of ligaments, where one or more slots of the plurality of slots define an electrical path. Moreover, the emitter device includes a low work function layer disposed on at least a portion of a ligament of the plurality of ligaments.

15 Claims, 6 Drawing Sheets

(56) References Cited

U.S. PATENT DOCUMENTS

| | | | | |
|---|---|---|---|---|
| 7,693,265 | B2 * | 4/2010 | Hauttmann | H01J 35/06 378/136 |
| 7,795,792 | B2 * | 9/2010 | Arnold | H01J 35/06 313/271 |
| 7,903,788 | B2 * | 3/2011 | Moore | H01J 35/06 378/121 |
| 7,924,983 | B2 * | 4/2011 | Moore | H01J 1/15 378/122 |
| 8,000,449 | B2 * | 8/2011 | Hauttmann | H01J 35/06 313/310 |
| 8,077,829 | B2 * | 12/2011 | Moore | H01J 1/20 378/136 |
| 8,175,222 | B2 * | 5/2012 | Moore | H01J 35/06 378/129 |
| 8,183,756 | B2 * | 5/2012 | Terletska | H01J 1/13 313/310 |
| 8,223,923 | B2 * | 7/2012 | Filmer | H01J 35/06 313/341 |
| 8,254,526 | B2 * | 8/2012 | Hauttmann | H01J 1/13 378/136 |
| 8,294,350 | B2 * | 10/2012 | Freudenberger | H01J 1/16 313/341 |
| 8,350,459 | B2 * | 1/2013 | Qian | H01J 1/304 313/309 |
| 8,385,506 | B2 * | 2/2013 | Lemaitre | H01J 1/20 378/136 |
| 8,401,151 | B2 * | 3/2013 | Frontera | H01J 35/14 378/136 |
| 8,553,843 | B2 * | 10/2013 | Drory | H01J 35/108 378/125 |
| 8,831,178 | B2 * | 9/2014 | Lemaitre | H01J 35/06 378/136 |
| 9,251,987 | B2 * | 2/2016 | Zhang | H01J 35/06 |
| 2009/0146547 | A1 | 6/2009 | Qian et al. | |
| 2010/0045212 | A1 | 2/2010 | Mancevski | |
| 2010/0239828 | A1 | 9/2010 | Cornaby et al. | |
| 2011/0142193 | A1 | 6/2011 | Frontera et al. | |
| 2011/0188637 | A1 | 8/2011 | Lemaitre et al. | |
| 2011/0249803 | A1 | 10/2011 | Drory | |

OTHER PUBLICATIONS

King et al.,"Low Work Function Material Development for the Microminiature Thermionic Converter", Sandia National Laboratories, Mar. 2004; 115 Pages.

Kirley etal.,"Effect of Sputtered Lanthanum Hexaboride Film Thickness on Field emission from Metallic Knife Edge Cathodes", Journal of Applied Physics, vol. 111, Issue 6, 2012, 7 Pages.

* cited by examiner

EMITTER DEVICES FOR USE IN X-RAY TUBES

BACKGROUND

Embodiments of the present specification relate to electron emitters, and more particularly to electron emitter devices for use in X-ray tubes.

Typically, X-ray tubes are used in non-invasive imaging systems. Non-limiting examples of such non-invasive imaging systems may include X-ray systems and computed tomography (CT) systems. In these systems, the X-ray tubes are used as a source of X-ray radiation. Further, the X-ray radiation is emitted in response to control signals transmitted during an examination or an imaging sequence. Usually, an X-ray tube includes a cathode and an anode. Further, the cathode may include an emitter. The emitter is configured to emit a stream of electrons in response to an applied electrical current, and/or an electric field resulting from an applied voltage. This stream of electrons is then directed towards the anode disposed in a path of the electron beam. Typically, the anode is in the form of a metallic plate. Additionally, the anode may include a target that is impacted by the stream of electrons. The target may produce X-ray radiation as a result of impact of the stream of electrons. The X-ray radiation is emitted toward a volume of interest in a subject that needs to be imaged.

In non-invasive imaging systems, in operation, the X-ray radiation passes through the subject, such as a patient, baggage, or an article of manufacture. Further, image data is collected when at least a portion of this X-ray radiation that passes through the subject impacts a detector or a photographic plate. In the case of digital X-ray systems, a photodetector produces signals representative of the amount or intensity of radiation impacting discrete elements of a detector surface. Further, in the case of CT systems, a detector array, including a series of detector elements, produces detected signals through various positions as a gantry is rotated about a patient. By way of example, each detector element of the detector array produces a separate electrical signal indicative of the attenuated beam received by each detector element.

Moreover, the electrical signals produced by the detector in response to the detected radiation are processed to generate an image that may be displayed for review. Further, electrical signals may be transmitted to a data processing system for analysis. The data processing system may be configured to process the electrical signals to facilitate generation of an image of the volume of interest in the subject.

Furthermore, intensity requirements for X-ray tubes used in applications, such as computed tomography, have steadily grown with the manifold possibilities of computed tomography. For example, applications of X-rays require high intensity X-rays and smaller focal spots (FS) for higher image quality. Present day's high-end X-ray tubes directly heated flat emitters are used that are structured to define an electrical path. Further, the flat emitters are configured to obtain the required high electrical resistance. However, in directly heated flat emitters, an unavoidable temperature gradient arises due to heat dissipation through the contacts. At hottest points, referred to as "hot spots" in the emitters the material evaporates in an intensified manner. The resulting decrease in the cross-section of the current-carrying path that results leads to the failure of the emitter due to additional heating, melting or fusing.

Attempts have been made to achieve an optimally homogeneous temperature distribution on a surface of the emitter and to lower a temperature at the hot spots on the surface of the emitter. It may be noted that lowering the temperature at the hot spots may result in less material being evaporated from these hot spots, and the lifetime of the emitter being prolonged accordingly. There are chances that after a prolonged use of the emitter, the emitter may develop a fracture at the hot spots.

Further, when the flat emitters are used as an electron source in an X-ray tube application, it is desirable to lower the voltage necessary for the thermionic emitter elements to generate an electron beam, so as to lower the probability of breakdown caused by operational failures and structural wear associated with an overvoltage being applied to the gate layer. Additionally, the emitter may contain one or more surface defects. By way of example, the emitter may have surface defects occurring due to machining. Further, the surface defects may result in a change in direction and/or intensity distribution of electron beams being emitted from the emission surface, thereby adversely affecting properties, such as, a size of the focal spot, or the electron beams.

Moreover, occurrence of mechanical damage due to wear and tear is typically higher at edges of the emission surface. Further, this wear and tear renders the surface at the edges of the emission surface uneven. Consequently, electron beams emitted from the edges of the emission surface may not conform to the electron beams that are being emitted from other non-damaged portions of the emission surface. In particular, the electron beams emitted from the edges of the emission surface may be divergent in nature. These divergent electron beams may prevent the electron beams from focusing onto a small, useable focal spot on the anode. Accordingly, such wear and tear prevents the electron beam from forming a small size focal spot on the target.

BRIEF DESCRIPTION

In accordance with aspects of the present specification, an emitter device having an emission surface is provided. The emitter device includes a plurality of ligaments configured to emit electrons in response to an applied electric field resulting from an applied electrical voltage. Further, the emitter device includes a plurality of slots configured to provide physical separation between two or more adjacently disposed ligaments of the plurality of ligaments, where one or more slots of the plurality of slots define an electrical path. Moreover, the emitter device includes a low work function layer disposed on at least a portion of a ligament of the plurality of ligaments.

In accordance with another aspect of the present specification, an X-ray imaging system is presented. The X-ray imaging system includes an X-ray tube configured to produce X-ray beams having a determined size of a focal spot includes an emitter device having an emission surface. Further, the emitter device includes a plurality of ligaments, a plurality of slots and a low work function layer disposed on at least a portion of a ligament of the plurality of ligaments.

In accordance with yet another aspect of the present specification, a method of making an emitter device is presented. Further, the method includes providing an emitter body having an emission surface, where the emission surface includes a plurality of ligaments and a plurality of slots configured to provide physical separation between two or more adjacently disposed ligaments of the plurality of ligaments. Further, the method includes selectively disposing a low work function layer disposed on at least a portion of a ligament of the plurality of ligaments.

DRAWINGS

These and other features, aspects, and advantages of the present disclosure will become better understood when the following detailed description is read with reference to the accompanying drawings in which like characters represent like parts throughout the drawings, wherein.

Figure 5:
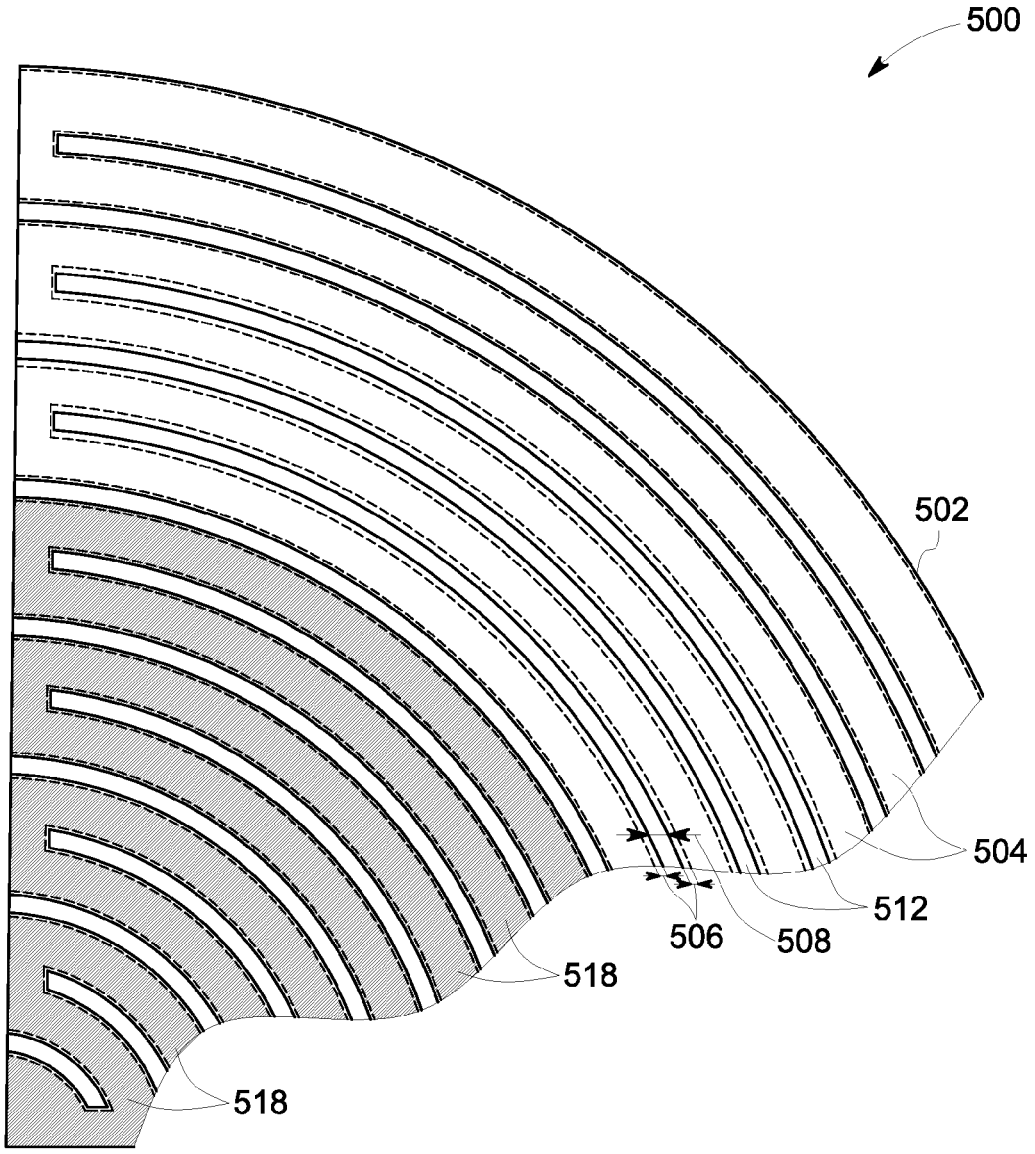
Figure 6:
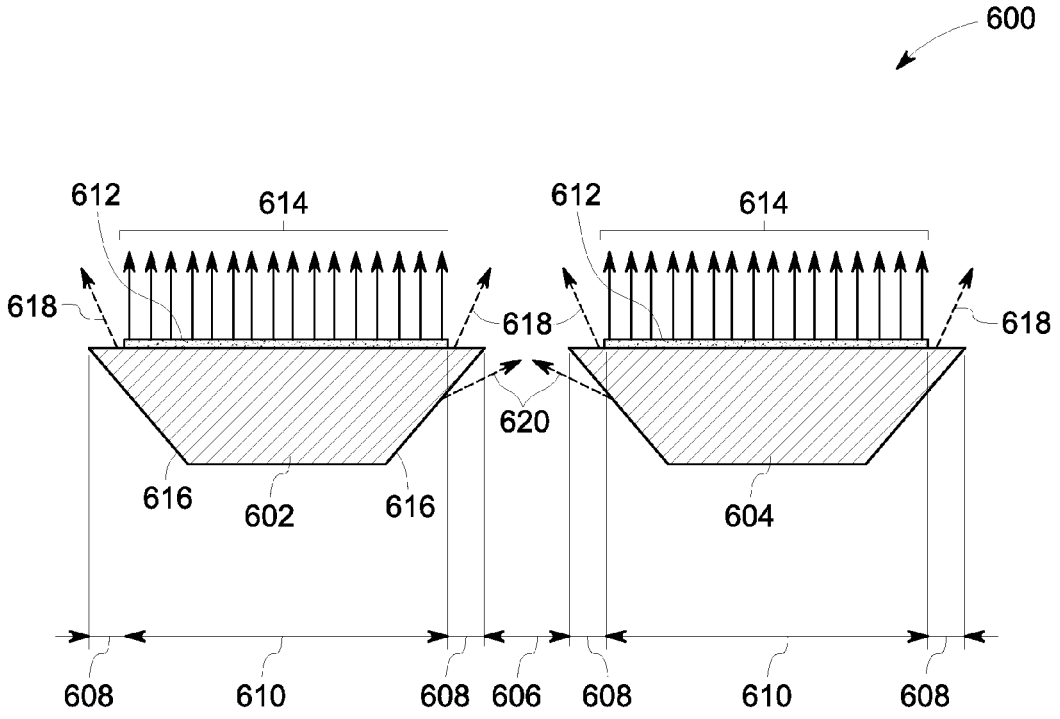
Figure 7:
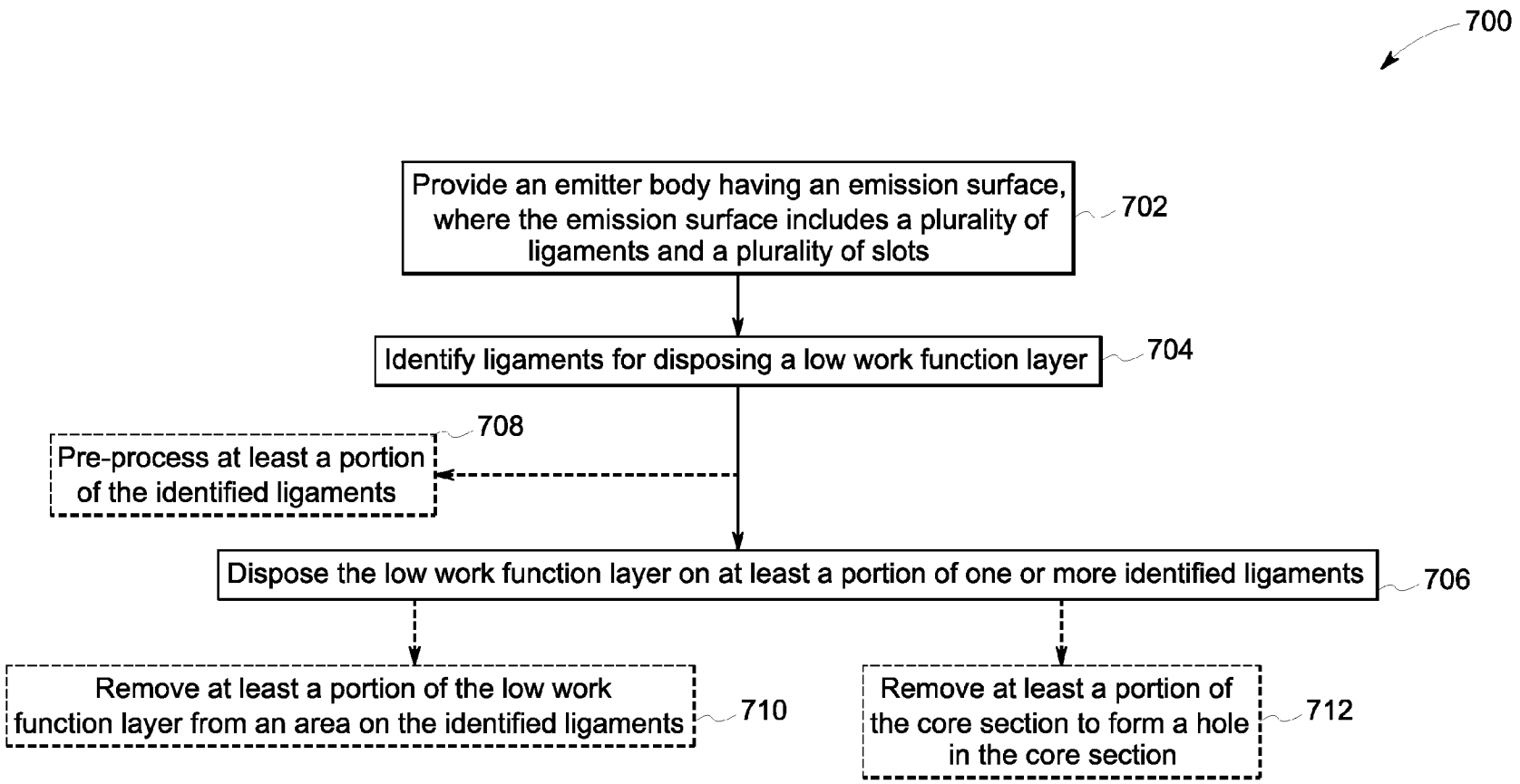

FIG. 5 is a top view of a portion of an emission surface having a plurality of ligaments, where some ligaments of the plurality of ligaments have a low work function layer disposed on a non-peripheral portion of the ligaments, and some other ligaments of the plurality of ligaments have a low work function layer disposed on a peripheral and the non-peripheral portion of the ligaments, in accordance with aspects of the present specification;

FIG. 6 is a cross-sectional side view of a portion of an emission surface, where the portion of the emission surface includes two adjacently disposed ligaments, and where at least a portion of the two adjacently disposed ligaments include a low work function layer, in accordance with aspects of the present specification; and FIG. 7 is a flow chart of an example method of making an emitter device having a low work function layer disposed on one or more ligaments of a plurality of ligaments of an emission surface, in accordance with aspects of the present specification.

DETAILED DESCRIPTION

Embodiments of the present specification relate to emitter devices and systems employing the emitter devices. The emitter devices may be configured to provide electron beams having a focal spot with a desirable size. Further, embodiments of the present specification provide methods for making the emitter devices that are configured to emit electron beams such that the electron beams are substantially parallel to one another to provide the electron beams having the desirably sized focal spot. In some embodiments, the emitter devices may be used in conjunction with a cathode assembly of an X-ray tube.

In certain embodiments, an emitter device of the present specification includes an emission surface having a plurality of ligaments and a plurality of slots. Further, each ligament of the plurality of ligaments is configured to emit electrons in response to an applied electric field resulting from an applied electrical voltage. Moreover, one or more slots of the plurality of slots define an electrical path. Additionally, ligaments of the plurality of ligaments may be disposed adjacent one or more slots of the plurality of slots.

In some embodiments, one or more ligaments may be theoretically divided into a peripheral portion and a non-peripheral portion, where the peripheral portion may be a portion of the ligament that is disposed adjacent a periphery of the ligament, whereas, the non-peripheral portion may be a portion of the ligament that is disposed within the peripheral portion. In particular, at least a portion of the peripheral portion of the ligament may be disposed adjacent one or more slots. By way of example, in instances where the ligament is sandwiched between a first slot and a second slot, a part of the peripheral portion may be disposed adjacent the first slot, and another part of the peripheral portion may be disposed adjacent the second slot. Further, in certain embodiments, a percentage of the peripheral portion may be in a range from about 1% to about 50% of a total area of a ligament. In certain other embodiments, the percentage of the peripheral portion may be in a range from about 20% to about 50% of a total area of the ligament. Further, the percentage of the peripheral portion may vary from one ligament to another ligament of the plurality of ligaments.

In certain embodiments, the emitter device includes a low work function layer disposed on at least a portion of one or more ligaments of the plurality of ligaments. In certain embodiments, the low work function layer may be disposed on one or more ligaments that have a homogeneous electric field. In some embodiments, the low work function layer may be disposed on both the peripheral and non-peripheral portions of a ligament. Whereas, in some other embodiments, the low work function layer may be disposed primarily on the non-peripheral portion of the ligament. It may be noted that in some instances the peripheral portion of the ligament may have surface irregularities, such as, but not limited to, a crack, a dent, chipping, cavity, or combinations thereof. The surface irregularities may be caused due to wear and tear during operation of the device, such as the X-ray tube employing the emitter device. Alternatively, the surface irregularities may be caused due to manufacturing of the emission surface. By way of example, a fragment of the peripheral portion may be chipped while forming an adjacent slot on the emission surface. In operation, such surface irregularities may result in formation of hot spots. Further, the presence of the hot spots may result in overheating of the regions having the hot spots, and undesirably fast depletion of material of the emitter body from such regions. Moreover, electrons emitting from these portions having the surface irregularities may be non-perpendicular to the emission surface. The non-perpendicular direction of the emitted electrons may result in divergent electron beams. Consequently, the electron beams may have a large focal spot. In particular, the divergent electron beams may have electrons that are not concentrated in a small focal spot. Such undesirable and non-ideal electron beams may result in X-ray images having sub-optimal quality.

Additionally or alternatively, the low work function layer may not be disposed on a portion of the entire ligament, where the portion of the entire ligament may produce distorted or inhomogeneous electric fields as the regions having the distorted electric fields tend to produce non-parallel, or divergent electron beams, hence, if the low work function layer is not disposed on such ligaments, production of the divergent electron beams may be restrained to a desirable extent. For example, the distorted electric field may be caused due to surface defects, surface irregularities, mechanical damage, or combinations thereof.

Further, in certain embodiments, the emission surface may be made of three (3) sections namely a core section, an intermediate section and an edge section, where the intermediate section is disposed between the core section and the edge section. The 3 portions, namely the edge section, the intermediate section and the core section together form the emission surface. The 3 portions may or may not be mechanically disjoint. However, for the purpose of the present specification, the 3 portions may be described individually. The 3 portions will be described in greater detail at least with respect to FIGS. 4-5. In some embodiments, the ligaments disposed in the intermediate section of the emission surface may include the low work function layer. Consequently, in these embodiments, the ligaments disposed in the intermediate section of the emission surface may be configured to emit electrons. Accordingly, in operation, the one or more ligaments disposed in the intermediate section are configured to emit electrons.

Advantageously, in certain embodiments, the emitter device of the present specification may be configured to produce electron beams that are substantially parallel to one another. Moreover, the emitter device may be configured to provide focal spots of electrons, where the focal spots have enhanced electron intensity. In particular, the emitter device is configured to reduce or eliminate one or more non-parallel electron beams that may otherwise be emitted from an emission surface of a conventional electron emitter. In some embodiments, the emitter device may be configured to curtail the production of divergent electron beams. It may be noted that electron beams having smaller focal spots, or focal spots that have higher density favorably affect the quality of X-ray beams produced using such electron beams.

Moreover, the emitter device of the present specification is configured to maintain a relatively uniform temperature across each ligament. For example, disposing the low work function layer on uniform portions of the ligament that are disposed in the intermediate section of the emission surface prevents formation and hot spots on the emission surface, and facilitates uniform temperature distribution across the emission surface. Maintaining a uniform temperature across the intermediate section, in particular, preventing the formation of hot spots in the ligaments disposed in the intermediate section enhances the mechanical stability of the emitter device. Additionally, having the uniform temperature during operation reduces the chances of having non-uniformity in the orientation or properties of the electron beams and hence the resultant X-rays. Disadvantageously, the presence of one or more hot spots in the intermediate section or elsewhere on the emission surface may result in an irregular temperature distribution on the electron beam target, which in turn may adversely affect the target life and beam quality of the resultant X-ray beam. Whereas, a uniform temperature distribution across the intermediate section may provide X-ray beams that form a focal spot having a desirable size and properties, such as, but not limited to, shape and intensity. Further, in one example, the uniform temperature distribution on the emission surface may result in a robust focal spot for imaging purposes. In addition, a lack of hot spots on the emission surface, which is a result of relatively uniform temperatures maintained during electron emission, may result in a longer usable life for the emitter. As will be appreciated, the longer usable life of the emitter is cost-effective and desirable for good maintenance of the emitter device. Further, the emitter devices provided herein may have a relatively larger diameter as compared to existing electron emitter devices that provide high emission and long usage lives.

In certain embodiments, the emitter devices may be used in conjunction with any suitable X-ray systems. In one embodiment, the emitter device may be used in an operating environment of a sixty-four-slice computed tomography (CT) system. While described with respect to an embodiment of a CT scanner, the emitter devices of the present specification may be equally applicable to other X-ray based systems, including fluoroscopy, mammography, angiography, and standard radiographic imaging systems as well as radiation therapy treatment systems. Additionally, the emitter devices are suitable for use with other applications in which an electron gun and/or electron emitter is implemented, whether for X-ray emission or otherwise.

Figure 1:
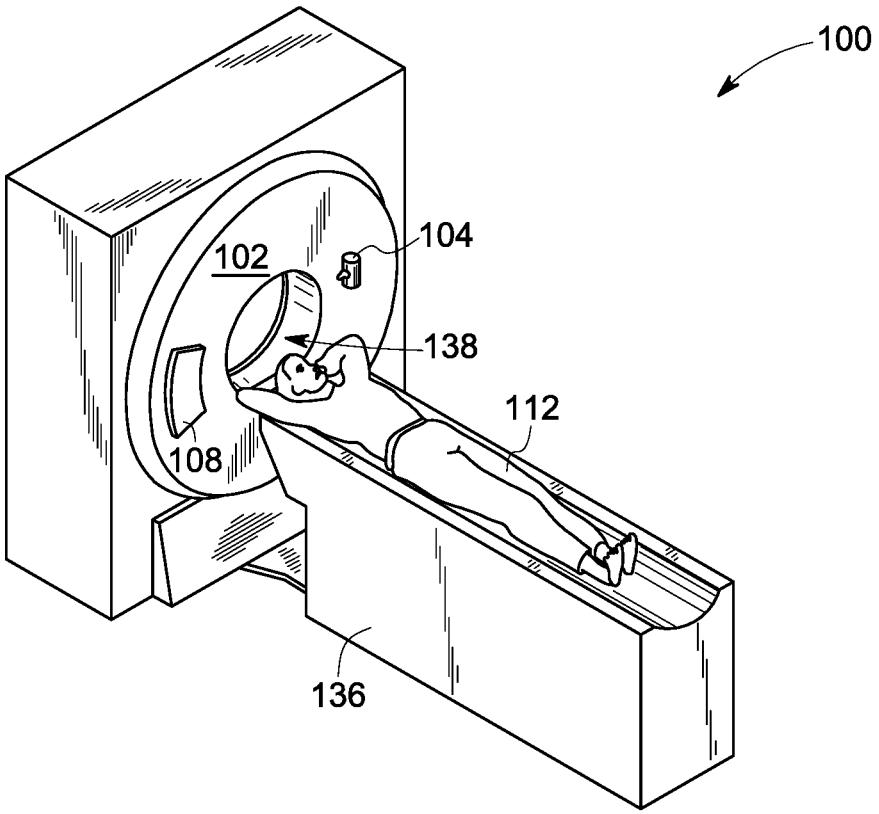
FIG. 1 is a pictorial view of a computed tomography (CT) imaging system, in accordance with aspects of the present specification.
Figure 2:
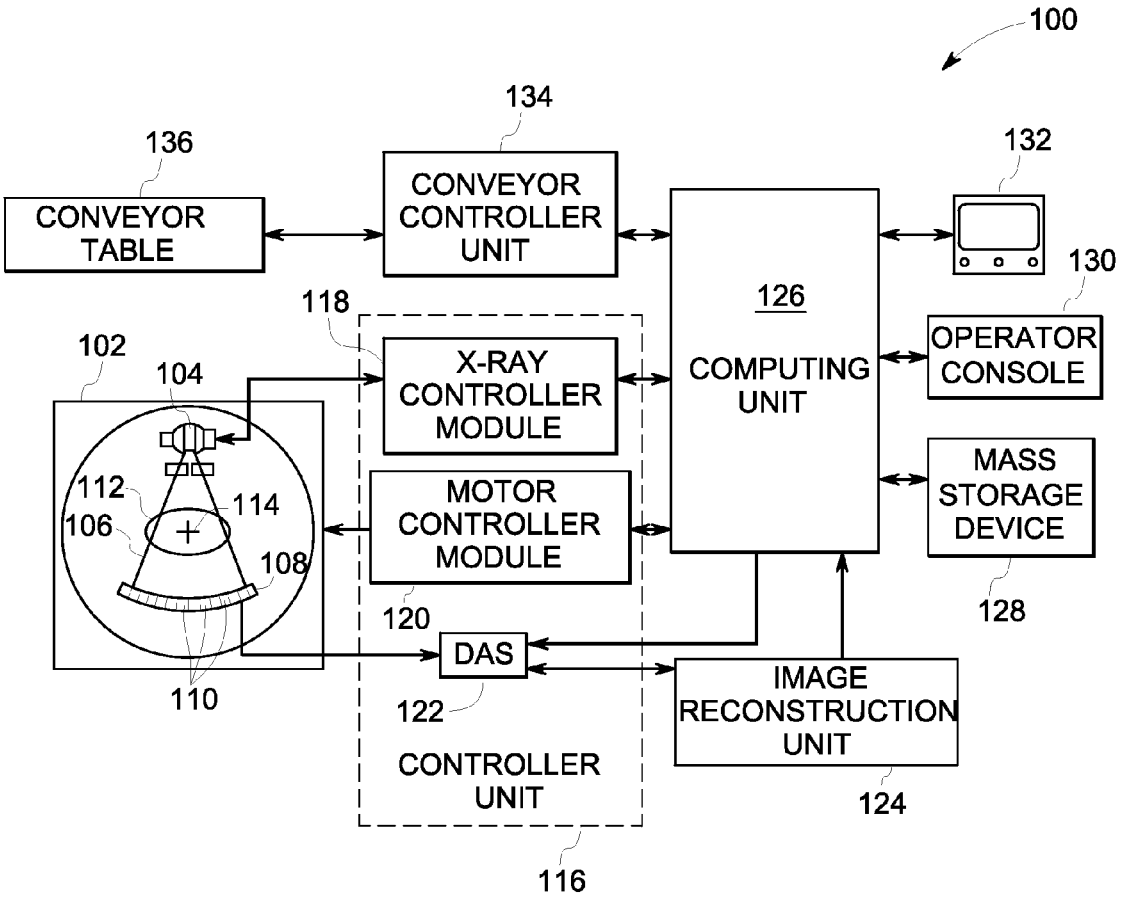
FIG. 2 is a schematic representation of the CT imaging system of FIG. 1, in accordance with aspects of the present specification.

Referring now to FIGS. 1 and 2, a computed tomography (CT) imaging system 100 is illustrated. The CT imaging system 100 includes a gantry 102. The gantry 102 may include an X-ray source 104. Further, the X-ray source 104 includes an emitter device (not shown) of the present specification. Moreover, the X-ray source 104 may include an X-ray tube (not shown) that is configured to project X-ray beams 106 towards a detector array 108. In some embodiments, the detector array 108 may be positioned opposite the X-ray source 104 on the gantry 102. In one embodiment, the gantry 102 may have two or more X-ray sources 104 for projecting the X-ray beams 106.

The detector array 108 may include a plurality of detectors 110. The plurality of detectors 110 may be collectively or individually configured to sense the projected X-ray beams 106 that pass through an object, such as a patient 112, to be imaged. Further, during a scan to acquire projected X-ray data, the gantry 102 and the components mounted on the gantry 102 may be rotated about a center of rotation 114 of the gantry 102. While the CT imaging system 100 is shown in reference to the medical patient 112, it should be appreciated that the CT imaging system 100 may have applications outside the medical realm. For example, the CT imaging system 100 may be utilized for ascertaining the contents of closed articles, such as luggage, packages, and the like, and in search of contraband such as explosives and/or bio-hazardous materials.

Further, rotation of the gantry 102 and the operation of the X-ray source 104 may be controlled by a controller unit 116 of the CT imaging system 100. The controller unit 116 includes an X-ray controller module 118. Further, the X-ray controller module 118 is configured to provide power and timing signals to the X-ray source 104. Moreover, the X-ray controller module 118 is configured to provide power and timing signals to a gantry motor controller module 120. The gantry motor controller module 120 may be configured to control the rotational speed and position of the gantry 102. Further, in addition to the X-ray controller module 118 and the gantry motor controller module 120, the controller unit 116 may also include a data acquisition sub-system (DAS) 122. The data acquisition sub-system 122 may be configured to sample analog data from the detectors 110. Moreover, the data acquisition sub-system 122 in the controller unit 116 may be configured to convert the analog data to digital signals for subsequent processing.

Additionally, the CT imaging system 100 may include an image reconstruction unit 124 that is configured to receive sampled and digitized X-ray data from the DAS 122. Further, the image reconstruction unit 124 is configured to perform high-speed image reconstruction. Moreover, the CT imaging system 100 may also include a computing unit 126 may be configured to store the reconstructed image in a mass storage device 128. In some embodiments, the reconstructed image may be used as an input to the computing unit 126. In one example, the computing unit 126 may include a computer, a processor, a central processing unit, or combinations thereof.

In certain embodiments, the computing unit 126 may also receive commands and scanning parameters from an operator via an operator console 130. In one example, the operator console 130 may have one or more input devices such as, but not limited to, a keyboard, a mouse, a trackball, a joystick, a touch-activated screen, a light wand, a control panel, and/or an audio input device (e.g., a microphone) associated with corresponding speech recognition circuitry. The input device may also allow a user, such as a medical practitioner, operating the CT imaging system 100 to request for image-derived information such as diffusion lesion characteristics for evaluating stroke parameters corresponding to the patient 112.

Additionally, the CT imaging system 100 may include a display unit 132 that is configured to allow the operator to observe the reconstructed image and other data from the computing unit 126. Further, the commands and parameters supplied by the operator may be used by the computing unit 126 to provide control and signal information to the DAS 122, the X-ray controller module 118 and/or the gantry motor controller module 120. In addition, the computing unit 126 may be configured to operate a table motor or conveyor controller unit 134, which controls a conveyor table 136 to position the patient 112 in the gantry 102. Further, the conveyor controller unit 134 may be configured to position an object, such as baggage or luggage in the gantry 102. More particularly, the conveyor controller unit 134 may be configured to move the object through a gantry opening 138. Particularly, the conveyor table 136 moves portions of the patient 112 through the gantry opening 138 in the gantry 102. It may be noted that in certain embodiments, the computing unit 126 may operate the conveyor controller unit 134, which in turn controls the conveyor table 136.

Figure 3:
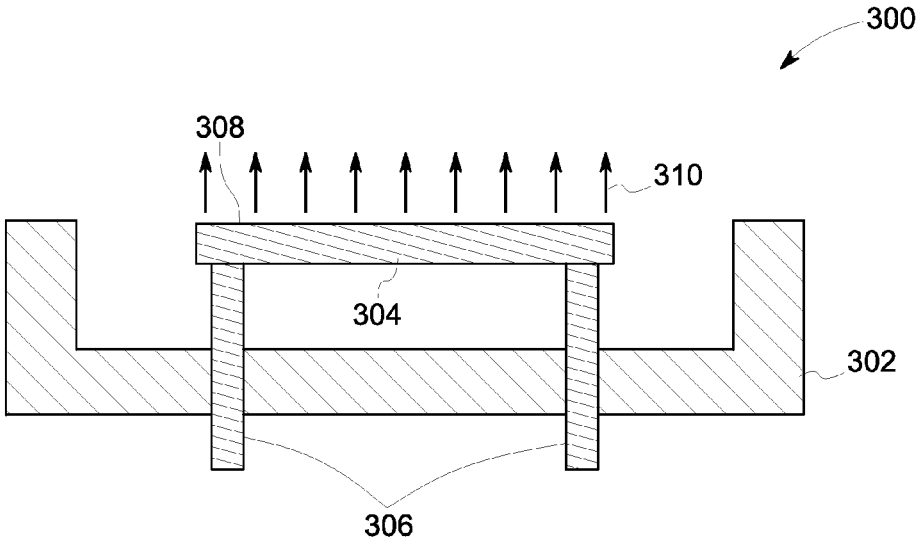
FIG. 3 is a cross-sectional view of an exemplary directly heated cathode assembly, in accordance with aspects of the present specification.

FIG. 3 illustrates a cross-sectional view of an embodiment of a directly heated cathode assembly 300 for use in an X-ray tube, such as the X-ray tube of the X-ray source 104 (see FIGS. 1 and 2) of the CT imaging system 100 of FIGS. 1 and 2. In certain embodiments, the directly heated cathode assembly 300 includes a cathode cap 302, an emitter device 304 and a terminal 306. Further, the terminal 306 may be operatively coupled to the emitter device 304 and configured to provide a desirable voltage to the emitter device 304 during operation of the directly heated cathode assembly 300. The emitter device 304 includes an emission surface 308 having a plurality of ligaments (not shown). Further, the emitter device 304 includes a low work function layer (not shown) disposed on selected ligaments of the plurality of ligaments of the emission surface 308 of the emitter device 304. The emitter device 304 is configured to emit electron beams 310 in response to an applied voltage. Further, emission of electron beams 310 from the emitter device 304 may be facilitated by the presence of the low work function layer (not shown) that is disposed on selected ligaments. Moreover, the ligaments on which the low work function layer is disposed may be selected so as to produce high-density electron beams 310 having a desirable focal spot size. Advantageously, the directly heated cathode assembly 300 is configured to provide electron emission in a relatively short interval after application of current.

Figure 4:
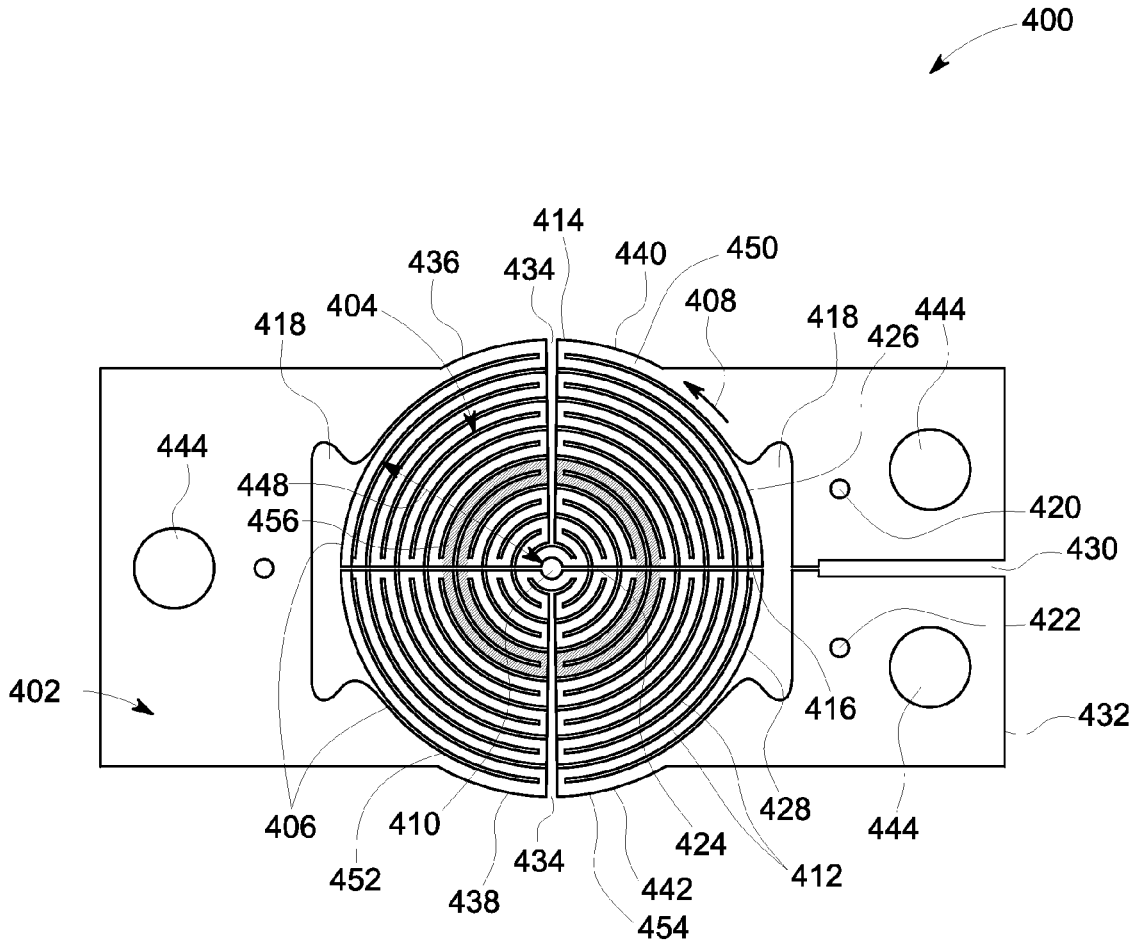
FIG. 4 is a top view of an emitter device having a low work function layer disposed on one or more ligaments of a plurality of ligaments of an emission surface, in accordance with aspects of the present specification.

FIG. 4 is a top view of an emitter device 400 that may be incorporated as part of the directly heated cathode assembly 300 (see FIG. 3) for emission of electron beams 310. The emitter device 400 includes an emitter body 402 having an emission surface 404. The emission surface 404 may be divided into 4 quadrants 406. The emitter device 400 may be configured to provide an electrical path to an applied voltage that is applied to the emitter device 400 for the purpose of producing electron beams 310, generally represented by an arrow 408. Further, in the illustrated embodiment, the electrical path 408 is generally radial in nature. In particular, the arrow 408 representative of the electrical path enters the emission surface 404 of the emitter device 400 at the outer diameter of the emission surface 404 and follows a pathway to a core section 410 of the emission surface 404 before entering another area (e.g., quadrant 406) of the emission surface 404 and following a path to the outer diameter of the emission surface 404 again. Further, by providing the emitter device 400 having the two or more separate areas (e.g., the 4 quadrants 406), a larger emission surface 404 may be formed. For example, in the depicted four-quadrant pattern, additional turns for the electrical path 408 may be maintained at a desired width while maintaining a driving current.

In some embodiments, the flow of electricity across the emission surface 404 and partly within the emitter body 402 results in the heating of the emission surface 404 and eventual electron emission when the emitter device 400 reaches sufficiently high temperatures. In certain embodiments, the emitter device 400 may be made of any suitable materials to facilitate electron emission, including tungsten, hafnium carbide (HfC), or other materials. Further, although the emitter device 400 is depicted as featuring a flat emission surface 404 it should be understood that the emission surface 404 or the emitter device 400, in certain embodiments, may be curved or otherwise non-planar.

For the purpose of the present specification, the emission surface 404 may be assumed to be divided into two or more sections depending primarily on the emission of electrons from the different sections. In the illustrated example, the emission surface 404 may include the core section 410, an intermediate section 448 and an edge section 450. The sections 410, 448 and 450 together may form the emission surface 404. The sections 410, 448 and 450 may or may not be physically separate and/or distinct; however, this distinction in nomenclature of the sections 410, 448 and 450 is to assist in understanding the aspects of the present specification. Further, although the emission surface 404 is illustrated as having four (4) quadrants 406, however, it may be noted that the emission surface 404 may be divided into areas other than the four (4) quadrants 406. The divisions of the emission surface 404 may be performed to facilitate electrical paths 408 on the emission surface 404.

In certain embodiments, the emission surface 404 includes a plurality of slots 412 and a plurality of ligaments 414. Further, one or more slots 412 of the plurality of slots 412 are configured to provide physical separation between any two adjacently disposed ligaments 414 of the plurality of ligaments 414. The slots 412 are configured to define an electrical path 408. In the illustrated embodiment, the slots 412 are designed to form a single serpentine radial electrical path 408 on the emission surface 404. Accordingly, each slot 412 may form a portion of the electrical path 408. A size of the slots 412 may be used to define the electrical path 408 and to allow for thermal expansion in a radial direction without shorting between neighboring ligaments 414. In a non-limiting example, the slots 412 are about 60 microns wide and the ligaments 414 are about 320 microns wide.

In certain embodiments, one or more ligaments 414 of the plurality of ligaments 414 are configured to emit electrons in response to an applied electric field. In one example, the applied electric field may result from an applied electrical voltage. The emission of electrons is substantially facilitated by the presence of a low work function layer 456. Further, the ligaments 414 having the low work function layer 456 are configured to emit electrons when heated above a determined temperature. As will be described in detail with respect to FIG. 5, in certain embodiments, the ligaments 414 may include a peripheral portion and a non-peripheral portion. Further, in some embodiments, the low work function layer 456 may be disposed substantially on the non-peripheral portions of the ligament 414.

Additionally, a size and number of the ligaments 414 and the slots 412 may be selected to influence the characteristics of the emission surface 404. For example, the ligaments 414 provide a radial path that changes direction at each turn 416, which is defined by the slots 412 and any other physical separation from the adjacent ligaments 414. The electrical path 408 winds around the emission surface 404 along the ligaments 414, changing direction at the turns 416. Further, temperature uniformity of the emission surface 404 may be enhanced by providing an electrical path 408 with more turns 416 and smaller driving current. Further, the width of the turns 416 may be adjusted to compensate for any hot spots, thereby improving the temperature uniformity of the emission surface when in operation.

As noted above, the emission surface 404 may be divided into the edge section 450, the intermediate section 448 and the core section 410. The intermediate section 448 may be defined as an area on the emission surface 404 that is disposed between the edge section 450 and the core section 410. In particular, the intermediate section 448 may be defined as an area on the emission surface 404 that is around the core section 410 but within an internal boundary 452 of the edge section 450. Further, the edge section 450 may be defined as section of the emission surface 404 disposed between an outer edge 454 and the internal boundary 452. Moreover, the internal boundary 452 may coincide with the outermost slot 412 on the emission surface 404. Hence, in one embodiment, the edge section 450 may be defined as an area disposed between the outer edge 454 of the emission surface 404 and the slot 412 disposed closest to the outer edge 454. In general, the low work function layer 456 may be disposed on one or more ligaments 414 present in the intermediate section 448 to enhance the electron beam emission and temperature uniformity in the emission surface 404. By way of example, the ligaments 414 disposed in the edge section 450 may have non-ideal electric field distribution. Further, one or more ligaments 414 disposed in the edge section 450 may experience mechanical wear and tear (e.g., during manufacturing or operation), thereby resulting in non-parallel electron beams 310. Accordingly, inhibiting the emission of electron beams 310 at least in part from the edge section 450 by selectively not disposing the low work function layer 456 on one or more ligaments 414 present in the edge section 450 may contribute to temperature uniformity and mechanical integrity of the emission surface 404. Further, absence of the low work function layer 456 on the core section 410 of the emission surface 404 may also enhance the temperature uniformity of the emission surface 404 and the overall quality of the focal spot formed by the electron beams 310.

In addition to selectively disposing the low work function layer 456 on one or more ligaments 414 of the intermediate section 448, the emitter device 400 may also include additional temperature uniformity features that facilitate cooling or distribution of heat across the emission surface 404. In some embodiments, these additional features may define the electrical path 408, including passageways 418 that electrically separate a terminal 420 from other terminals (e.g. terminal 422). For example, a size and shape of the passageways 418 may be selected to facilitate enhanced distribution of heat. Further, passageways 444 may also be formed in the emitter device 400 for this purpose. The passageways 444 may also be used as alignment holes for positioning the emitter device 400 within the cathode assembly.

Further, in certain embodiments, the emission surface 404 may include a channel 424 that bi-sects the emission surface 404. In particular, the channel 424 may separate a top half 426 of the emission surface 404 from a bottom half 428 of the emission surface 404, thereby preventing the ligaments 414 from having multiple paths within the emission surface 404. In some embodiments, the channel 424 may separate the emission surface 404 into substantially equal portions, depending on the shape of the emission surface 404. The channel 424 may also extend past the emission surface 404 into a wider notch 430 that terminates at an end 432 of a longest dimension of the emitter device 400. Further, the channel 424 may include heat distribution features, such as a passageway 444 formed in the core section 410 of the emission surface 404. The passageway 444 may be any suitable shape that facilitates regulating or smoothing the temperature. In one embodiment, the passageway 444 has a diameter of about 550 microns.

Further, in certain embodiments, the low work function layer 456 may be disposed on at least a portion of one or more ligaments 414 disposed in the intermediate section 448. It may be noted that the low work function layer 456 may be configured to assist in emission of electron beams 310 by lowering the work function of at least the portion of the emission surface 404 on which the low work function layer 456 is disposed. Non-limiting examples of materials of the low work function layer 456 may include, but are not limited to, hafnium carbide, tantalum carbide, hafnium diboride, zirconium carbide, hafnium nitride, tantalum nitride, zirconium nitride, tungsten diboride, or combinations thereof. Further, a thickness of the low work function layer 456 may be in a range from about 5 microns to about 100 microns. In certain embodiments, the thickness of the low work function layer 456 may depend on the type of material of the low work function layer 456, the material of the emitter body 402, desired intensity of the electron beams, or combinations thereof. Moreover, in some embodiments, at least one ligament 414 of the plurality of ligaments 414 may include a low work function layer 456 that is different from a low work function layer 456 disposed on other ligaments 414 of the plurality of ligaments 414.

In some embodiments, one or more ligaments 414 having the low work function layer 456 may be selected based on one or more factors, such as, but not limited to, a geometry of a corresponding ligament 414, dimensions of the corresponding ligament 414, a relative position of the corresponding ligament 414 on the emission surface 404, dimensions of slots 412 disposed adjacent to the corresponding ligament 414, an electrostatic field variation, mechanical uniformity of a surface of the corresponding ligament 414, or combinations thereof. In one embodiment, the electrostatic field variation may include variation of the electrostatic field in two or more directions on the emission surface 404. By way of example, in the illustrated embodiment, the two or more directions include an axial direction and a radial direction. In one example, the ligaments 414 having uniform electric field distribution may be selected to dispose the low work function layer 456.

Further, in some specific embodiments, the low work function layer 456 may be disposed on portions of the emission surface 404 where the electric field is substantially uniform. Disposing the low work function layer 456 on such portions with substantially uniform electric field facilitates laminar flow of electron beams 310 that are generated as a result of application of voltage to the emission surface 404. Advantageously, having a laminar flow of the electron beams 310 reduces or eliminates strayed electron beams that have substantially different motion from the rest of the electron beams 310. By way of example, the electron beams 310 having laminar flow have lower emittance in nature, thus ensuring a focused focal spot pattern on the target. A focused focal spot on the target ensures higher efficiency of X-ray generation with respect to the voltage applied to the emission surface 404. This high efficiency of X-ray generation and smaller focal spot size positively affect the image quality of a subject being imaged by the X-rays that are generated.

In certain embodiments, the low work function layer 456 may be disposed individually on a group of adjacently disposed ligaments 414. In some of these embodiments, a low work function layer 456 for a particular ligament 414 or a group of ligaments 414 may be the same. By way of example, the low work function layer 456 for adjacently disposed ligaments 414 may be same and may be determined based on an electrostatic field variation such that portions of the emission surface 404 that have electrostatic field above or below a determined threshold are prevented from contributing to the emission. In one embodiment, in a given portion of the emission surface 404 a pattern of the low work function layer 456 may be determined based on an electric field distribution in the given portion. In this embodiment, the pattern of the low work function layer 456 may include a group of ligaments 414 on which the low work function layer 456 is disposed and/or a material composition of the low work function layer 456 that is disposed on the ligaments 414 in the given portion.

In certain embodiments, one or more of the core section 410, the edge section 450, and surfaces of the slots 412 or the ligaments 414 may be prevented from contributing to the emission of electrons. Further, in some embodiments, one or more of the core section 410, the edge section 450, and the side surfaces of the slots 412 or the ligaments 414 may be prevented from contributing to the emission of electrons by virtue of not having the low work function layer 456.

The emitter device 400 may also include one or more v-shaped gaps 434 that partially separate portions of the emission surface 404 from one another. The v-shaped gaps 434 may have different angles, including a vertically shaped and inversely v-shaped geometry. For example, the depicted embodiments show two v-shaped or tapered gaps 434 that separate left quadrants (436 and 438) from right quadrants (440 and 442) of the emission surface 404. As illustrated, the v-shaped gaps 434 leave a single electrical path 408 between the left quadrants 436 and 438 and the right quadrants 440 and 442. In one embodiment, the v-shaped gaps 434 may be aligned along an axis (e.g., a diameter axis). In another embodiment, the v-shaped gaps 434 are orthogonal to the channel 424.

Further, in certain embodiments, the emitter device 400 is configured to expand within the one or more v-shaped gaps 434 when heated such that the one or more v-shaped gaps 434 decreases in size without permitting adjacent lobes or sections to touch one another. In particular, the v-shaped gaps 434 may be generally wider as they extend radially away from the center of the emitter device 400. Further, this allows longer ligaments 414 located towards the outer circumference of the emitter device 400 to expand more than relatively shorter ligaments 414. Also, shorter ligaments 414 may expand less, which facilitates a relatively narrower gap. The size of the v-shaped gaps 434 may be selected to permit expansion but also to minimize loss of emission area.

Moreover, the v-shaped gaps 434 taper towards the center of the emission surface 404 such that the gap length varies and is narrowest towards the hole or core section 410. In one embodiment, the v-shaped gap 434 may have a gap length that varies between about 120 microns to about 240 microns. Further, the v-shaped gap 434 may be characterized by a ratio of a widest gap length to a narrowest gap length of about 2 or more. That is, the widest point of the v-shaped gap 434 may be twice as wide or more as the narrowest point. The channel 424 may have a gap length $l_2$ that is generally of a constant size. In one embodiment, the gap length of the channel 424 is less than about 240 microns. In another embodiment, the gap length of the channel 424 is between about 120 microns to about 240 microns.

Further, the size and shape of the emitter device 400 may be selected based on suitable dimensions to be used in conjunction with the cathode assembly. In a particular embodiment, the longer dimension of the emitter device 400 may be about twice the diameter of the emission surface 404. In another embodiment, the shorter dimension of the emitter device 400 may be about the diameter of the emission surface 404. Additionally, it may be noted that although in the illustrated embodiment, the emitter device 400 is shown to have a circular emission surface 404, however, in some other embodiments, a shape of the emission surface 404 may be other than the circular shape. Examples of the shape of the emission surface 404 may include a rectangular shape, a square shape, or any other geometrical or non-geometrical shapes. Further, it may be noted that a shape of the ligaments 414 of the emission surface 404 may change according to the shape of the emission surface 404. Moreover, a shape of the four (4) quadrants 406 of the emission surface 404 may include other geometrical (e.g., a rectangular shape, a square shape) or non-geometrical shapes.

FIG. 5 illustrates a portion 500 of an exemplary emitter device having an emission surface 502. The emission surface 502 includes a plurality of ligaments 504. Each ligament 504 of the plurality of ligaments 504 includes a peripheral portion 506 and a non-peripheral portion 508. The peripheral portion 506 may be around the periphery of the ligament 504. Consequently, the peripheral portion 506 may be disposed adjacent to one or more slots 512. In some embodiments, the peripheral portion 506 may be at least about 5% of a total area of a ligament 504 of the plurality of ligaments 504. In some other embodiments, the peripheral portion 506 may be in a range from about 5% to about 60% of the total area of the ligament 504 of the plurality of ligaments 504. Further, in certain embodiments, a ratio of the peripheral portion 506 and the non-peripheral portion 508 may vary from one ligament 504 to another ligament 504 of the same emission surface 502. In particular embodiments, the ratio of the peripheral portion 506 and the non-peripheral portion 508 may be based on a geometry of a corresponding ligament 504 of the plurality of ligaments 504, a location of the corresponding ligament 504 on the emission surface 502, dimensions of the corresponding ligament 504, a relative position of the corresponding ligament 504 on the emission surface 502, dimensions of slots 512 disposed adjacent to the corresponding ligament 504, electrostatic field variation in the corresponding ligament 504, or combinations thereof.

Further, the peripheral portion 506 may include surface irregularities. In one non-limiting example, the surface irregularities may occur during manufacturing of the portion 500 of the emitter device. In particular, the surface irregularities may appear during formation of slots 512 on the emission surface 502. In some embodiments, a low work function layer 518 may be disposed on the peripheral portion 506, the non-peripheral portions 508, or both the peripheral and non-peripheral portions 506 and 508 of some ligaments 504. For example, in case of ligaments 504 that have a substantially uniform surface in both the peripheral and non-peripheral portions 506 and 508, the low work function layer 518 may be disposed on both the peripheral and non-peripheral portions 506 and 508 of the ligaments 504. The substantially uniform surface of the ligaments 504 may contribute to a substantially uniform electric field, resulting in a substantially parallel and uniform electron beam 310 that is perpendicular to the emission surface 502.

FIG. 6 represents a portion 600 of an emitter device having two adjacently disposed ligaments 602 and 604 and a slot 606 disposed between the ligaments 602 and 604. Further, the ligaments 602 and 604 include peripheral portions 608 and non-peripheral portions 610. A low work function layer 612 is disposed on the non-peripheral portions 610 of the ligaments 602 and 604. Solid arrows 614 represent electron beams that are emitted from the non-peripheral portions 610 of the ligaments 602 and 604 having the low work function layer 612. As illustrated, the low work function layer 612 is not disposed on the peripheral portions 608 of the ligaments 602 and 604. Further, the low work function layer 612 is not disposed on side surfaces 616 of the ligaments 602 and 604 or the slot 606. Absence of the low work function layer 612 from the peripheral portions 608 of the ligaments 602 and 604 and the side surfaces 616 of the ligaments 602 and 604 or the slot 606 prevents emission of non-parallel electron beams, which may have been otherwise emitted if the low work function layer 612 was disposed on the peripheral portions 608 or the side surfaces 616 of the ligaments 602 and 604 or the slot 606.

These imaginary non-parallel electron beams that may have been emitted from the peripheral portions 608 are represented by reference numeral 618. Further, the imaginary non-parallel electron beams that may have been emitted from the side surfaces 616 of the ligaments 602 and 604 or the slot 606 are represented by reference numeral 620. Accordingly, it may be noted that the combination of solid arrows 614 and dashed arrows 618 and 620 may result in a larger focal spot with non-uniform intensity within the focal spot. Further, absence of the low work function layer 612 from the peripheral portions 608 and the side surfaces 616 of the ligaments 602 and 604 enable the formation of the parallel electron beams 614 that have a small focal spot. Accordingly, advantageously, the emitter devices of the present specification provide robust focal spot having a desirable size. Further, the present specification provides devices and methods to eliminate electron beams 618 and 620 having undesirable orientation. By way of example, the present specification provides devices, systems and methods to eliminate electron beams 618 and 620 having undesirable properties, such as, but not limited to, orientation and intensity.

FIG. 7 illustrates a flow chart for a method 700 of making an emitter device in accordance with aspects of the present specification. In the illustrated embodiment of FIG. 7, the method 700 begins at block 702 by providing an emitter body having an emission surface. The emission surface includes a plurality of ligaments and a plurality of slots. The slots are configured to provide physical separation between one or more ligaments of the plurality of ligaments. Further, in operation, the slots are configured to provide an electrical path to the applied electric current. Each ligament of the plurality of ligaments may include a peripheral and a non-peripheral portion. The peripheral and non-peripheral portions may not physically exist, however, the peripheral and non-peripheral portions may be defined based on surface uniformity of a surface of the emission surface. Further, the emission surface may be theoretically divided into an edge section, an intermediate section and a core section. The core section may be defined as an area near the center of the emission surface. Further, the core section may not include any ligaments. The edge section may be defined as an area along the periphery of the emission surface, and the intermediate section may be defined as an area of the emission surface that is disposed between the core section and the edge section.

At step 704, ligaments of the plurality of ligaments may be identified or selected for disposing a low work function layer. In particular, at least portions of the ligaments that have a uniform electrostatic field or have up to a desirable amount of variation in the electrostatic field may be identified for depositing the low work function layer.

Further, at step 706, a low work function layer may be selectively disposed on the identified ligaments of the plurality of ligaments. In a particular embodiment, the low work function layer may be selectively disposed on the identified ligaments of the plurality of ligaments disposed in the intermediate section of the emission surface.

In one embodiment, the step of selectively disposing the low work function layer may include depositing an initial layer of a low work function material on at least a portion of the emission surface. Further, the step of selectively disposing the low work function layer may include selectively removing the initial layer from at least a portion of the emission surface (e.g., one or more ligaments). In one example, the initial layer may be selectively removed from the ligaments that are not the identified ligaments. In the same of different example, the initial layer may be removed from a portion of the identified ligaments. In one embodiment, the step of selectively removing the initial layer may include removing the initial layer from at least a peripheral portion of one or more ligaments of the identified ligaments.

In some embodiments, a patterned mask may be used to deposit the low work function layer on the identified or selected ligaments. Further, the patterned mask may be used to deposit the low work function layer on desirable portions of the identified ligaments. By way of example, the desirable portions of the ligament may include non-peripheral portions. Alternatively, in some other embodiments, a continuous layer of the low work function material, also referred to as the initial layer, may be deposited on the entire emission surface. Subsequently, portions of the initial layer may be selectively removed from one or more areas of the emission surface to provide a low work function layer disposed on desirable portions of the identified ligaments of emission surface.

In certain embodiments, the low work function layer or the initial layer may be formed separately and then disposed on the portion of the one or more ligaments. In another embodiment, the low work function layer or the initial layer may be directly deposited on the portion of the one or more ligaments. Non-limiting examples of the techniques that may be used to deposit the low work function layer of the initial layer may include chemical vapor deposition, physical vapor deposition, sputtering, or other similar film deposition techniques.

Optionally, at step 708, prior to disposing the low work function layer or the initial layer at least a portion of the selected ligaments may be subjected to pre-processing. In one embodiment, the step of pre-processing may include cleaning the surface. By way of example, the intermediate section may be cleaned to remove grease and/or dirt. In another embodiment, the step of pre-processing may include treating the intermediate section to enhance one or more properties of at least the intermediate section, where the one or more properties may aid in disposing the low work function layer on the intermediate section. By way of example, the intermediate section may be subjected to surface roughening treatments, such as, but not limited to, sand blasting, etching, or combinations thereof. Additionally, in some embodiments, the emission surface may be subjected to one or more thermal treatments prior to disposing the low work function layer to maintain the intermediate section at a desirable temperature to aid in proper formation of the low work function layer on the intermediate section.

Alternatively or additionally, the step of pre-processing may also include treating the core section, the edge section, or both the core and the edge sections of the emission surface. By way of example, the edge and/or core sections may be treated to deter or prevent the low work function layer from being disposed on the edge and/or core sections. For example, in instances where the low work function layer is deposited or formed on the intermediate section, it may be desirable to treat the edge and/or core sections to enhance the smoothness index of the edge and/or core sections to prevent the low work function layer from being deposited or properly adhering to the edge and/or core sections.

Further, optionally, at block 712, at least a portion of the core section may be mechanically removed from the emission surface. In one example, the core section may be mechanically removed to form a through hole or a depression in the core section. Advantageously, the presence of hole in the core section of the emission surface improves the temperature uniformity in the emitter device by preventing emission of electrons from the core section. However, drilling of the hole results in increased machining cost. Hence, alternatively, and optionally, at block 710, if required, the portion of the initial layer of the low work function material disposed on the core section may be removed. Removing the low work function material from the core section reduces the emissivity of the core section. Further, removing the low work function material from the core section results in relatively more efficient heating of the emission surface without the core section being overly heated.

Further, at block 710, if required, the portions of the initial layer of the low work function material disposed on non-selected ligaments in the intermediate section, the edge section and the side surface may be removed. However, if the low work function layer is selectively disposed on identified portions of the emission surface, it may not be required to perform the step provided at block 710. By way of example, if a masking approach is used to dispose the low work function layer on the identified portions of the emission surface, it may be not be required to perform the step provided at block 710, as the low work function layer may be present only on the identified portions of the emission surface.

Additionally, in one embodiment, portions of the initial layer of the low work function material disposed on one or more slots of the plurality of slots separating the selected ligaments of the emission surface may be removed. Non-limiting examples of approaches that may be used to remove the portions of the low work function layer may include laser ablation, etching, sand blasting, or combinations thereof. In one example, the portions of the layer of the low work function material may be etched to selectively remove the portions of the layer of the low work function material from the emission surface.

It may be noted that the emitter device of the present specification may be retrofitted to existing devices and imaging systems. Further, it may not be necessary to make any additional changes to the existing systems to retrofit the emitter device. Advantageously, the emitter devices of the present specification exhibit enhanced focal spot quality with similar energy levels as are used conventionally. Further, enhanced focal spot quality facilitates improves image quality and enhanced spatial resolution for the images. Also, the emitter devices of the present specification exhibit improved life. In particular, the emitter devices provide enhanced life by virtue of having a rigid core section. Moreover, the methods of making the emitter devices provide a simplified manufacturing process and reduced cost of the emitter. Accordingly, the cost of the X-ray tube is reduced, and failures of the X-ray tube caused due to the failure of the emitter devices are also reduced.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The invention claimed is:

1. An emitter device comprising:

an emission surface, said emission surface comprising:

a plurality of ligaments configured to emit electrons in response to an applied electric field resulting from an applied electrical voltage, wherein each ligament of the plurality of ligaments comprises a peripheral portion and a non-peripheral portion;

a plurality of slots configured to provide physical separation between two or more adjacently disposed ligaments of the plurality of ligaments, wherein one or more slots of the plurality of slots define an electrical path; and a low work function layer disposed on at least a portion of a ligament of the plurality of ligaments, wherein the low work function layer is disposed on the non-peripheral portion of one or more ligaments of the plurality of ligaments.

2. The emitter device of claim 1, wherein a ratio of the peripheral portion and the non-peripheral portion varies from one ligament to another ligament.

3. The emitter device of claim 1, wherein a ratio of the peripheral portion and the non-peripheral portion varies from one ligament to another ligament.

4. The emitter device of claim 1, wherein a ratio of the peripheral portion and the non-peripheral portion is based on a geometry of a corresponding ligament of the plurality of ligaments, a location of the corresponding ligament, dimensions of the corresponding ligament, a relative position of the corresponding ligament on the emission surface, dimensions of slots of the plurality of slots disposed adjacent to the corresponding ligament, electrostatic field variation in the corresponding ligament, or combinations thereof.

5. The emitter device of claim 1, wherein the low work function layer is disposed on the peripheral portion and the non-peripheral portion of one or more ligaments of the plurality of ligaments.

6. The emitter device of claim 1, wherein the low work function layer comprises hafnium carbide, tantalum carbide, hafnium diboride, zirconium carbide, hafnium nitride, tantalum nitride, zirconium nitride, tungsten diboride, or combinations thereof.

7. An emitter device comprising:

an emission surface, said emission surface comprising:

a plurality of ligaments configured to emit electrons in response to an applied electric field resulting from an applied electrical voltage;

a plurality of slots configured to provide physical separation between two or more adjacently disposed ligaments of the plurality of ligaments, wherein one or more slots of the plurality of slots define an electrical path; and a low work function layer disposed on at least a portion of a ligament of the plurality of ligaments, wherein at least one ligament of the plurality of ligaments comprises a low work function layer that is different from a low work function layer disposed on other ligaments of the plurality of ligaments.

8. An emitter device comprising:

an emission surface, said emission surface comprising:

a plurality of ligaments configured to emit electrons in response to an applied electric field resulting from an applied electrical voltage;

a plurality of slots configured to provide physical separation between two or more adjacently disposed ligaments of the plurality of ligaments, wherein one or more slots of the plurality of slots define an electrical path; and a low work function layer disposed on at least a portion of a ligament of the plurality of ligaments, wherein each ligament of the plurality of ligaments comprises a side surface, and wherein the side surface is configured to not emit electrons in response to the applied electric field.

9. An emitter device comprising:

an emission surface, said emission surface comprising:

a plurality of ligaments configured to emit electrons in response to an applied electric field resulting from an applied electrical voltage;

a plurality of slots configured to provide physical separation between two or more adjacently disposed ligaments of the plurality of ligaments, wherein one or more slots of the plurality of slots define an electrical path; and a low work function layer disposed on at least a portion of a ligament of the plurality of ligaments, wherein the emission surface comprises a core section, an intermediate section and an edge section, and wherein one or more ligaments of the plurality of ligaments disposed in the intermediate section of the emission surface comprise the low work function layer.

10. The emitter device of claim 9, wherein the low work function layer is not disposed on the core section.

11. The emitter device of claim 9, wherein the core section comprises a hole.

12. An X-ray imaging system, comprising:

an X-ray tube configured to produce X-ray beams having a determined size of a focal spot, wherein the X-ray tube employs an emitter device having an emission surface, and wherein the emission surface comprises:

a plurality of ligaments configured to emit electrons in response to an applied electric field resulting from an applied electrical voltage, wherein each ligament of the plurality of ligaments comprises a peripheral portion and a non-peripheral portion;

a plurality of slots configured to provide physical separation between two or more adjacently disposed ligaments of the plurality of ligaments, wherein one or more slots of the plurality of slots define an electrical path; and a low work function layer disposed on at least a portion of a ligament of the plurality of ligaments, wherein the low work function layer is disposed on the non-peripheral portion of one or more ligaments of the plurality of ligaments.

13. The X-ray imaging system of claim 12, wherein the emitter device is configured to produce laminar electron beams.

14. The X-ray imaging system of claim 12, wherein the peripheral portion is in a range from about 5% to about 60% of a total area of a ligament of the plurality of ligaments.

15. A method of making an emitter device, comprising:

providing an emitter body having an emission surface, wherein the emission surface comprises:

a plurality of ligaments configured to emit electrons in response to an applied electric field resulting from an applied electrical voltage;

a plurality of slots configured to provide physical separation between two or more adjacently disposed ligaments of the plurality of ligaments, and wherein one or more slots of the plurality of slots define an electrical path; and selectively disposing a low work function layer on at least a portion of a ligament of the plurality of ligaments, comprising selecting one ore more ligaments of the plurality of ligaments;

depositing an initial layer of a low work function material on the selected one or more ligaments; and selectively removing at least a portion of the initial layer from the peripheral portion of the selected one or more ligaments.

* * * * *